US012648662B2

(12) United States Patent
Kao

(10) Patent No.: US 12,648,662 B2
(45) Date of Patent: Jun. 9, 2026

(54) BEAD CHAIN OR CORD RETAINER

(71) Applicant: UNI-SOLEIL ENTERPRISE CO., LTD., Tainan City (TW)

(72) Inventor: Yu-Ting Kao, Tainan City (TW)

(73) Assignee: Uni-Soleil Enterprise Co., Ltd., Tainan City (TW)

( * ) Notice: Subject to any disclaimer, the term of this patent is extended or adjusted under 35 U.S.C. 154(b) by 228 days.

(21) Appl. No.: 18/650,513

(22) Filed: Apr. 30, 2024

(65) Prior Publication Data

US 2025/0331671 A1 Oct. 30, 2025

(51) Int. Cl.
*A47H 3/10* (2006.01)

(52) U.S. Cl.
CPC ..... *A47H 3/10* (2013.01)

(58) Field of Classification Search
CPC ... A47H 3/02; A47H 3/10; A47H 1/18; A47H 1/19; A47H 11/00; A47H 11/02; A47H 11/04; E06B 9/326; E06B 9/324; E06B 9/325; E06B 9/78; E06B 9/58; E06B 9/80; E06B 2009/801; F16G 11/10
See application file for complete search history.

(56) References Cited

U.S. PATENT DOCUMENTS 4,118,838 A * 10/1978 Schiefer ..... F16L 3/10 248/68.1
4,453,292 A * 6/1984 Bakker ..... F16G 11/101 24/115 G
5,361,461 A * 11/1994 Anscher ..... F16G 11/101 24/136 R
5,737,808 A * 4/1998 Ikeda ..... F16G 11/101 24/136 L
6,038,746 A * 3/2000 Anscher ..... F16G 11/101 24/136 R
6,672,237 B2 * 1/2004 Hillier ..... F16G 11/101 114/218
8,650,720 B2 * 2/2014 Wicker ..... E06B 9/326 24/136 R
8,935,832 B2 * 1/2015 Chuang ..... A47H 3/02 248/261
9,017,296 B2 * 4/2015 Beck ..... A61M 39/28 604/249

(Continued)

FOREIGN PATENT DOCUMENTS

TW M415669 U 11/2011
TW M470616 U 1/2014
TW M649476 U 12/2023

*Primary Examiner* — Beth A Stephan
(74) *Attorney, Agent, or Firm* — Rosenberg, Klein & Lee

(57) ABSTRACT

A bead chain or cord retainer which includes a frame, a moving part, and an elastic member is provided. The moving part is mounted in and moved with respect to the frame and the elastic member is disposed between the frame and the moving part. A bead chain or a cord is inserted through a clipped and limited space formed by the frame and the moving part. The bead chain or a cord is generally held by the frame and the moving part and thus positioned. The moving part is pushed upward for mounting the retainer. Then a fastener is inserted through the frame and the moving part to be threaded into a wall. Relative positions of the frame and the moving part are fixed and the clipped and limited space is expanded. Thereby the bead chain or the cord is drawn smoothly to open or close curtains.

18 Claims, 15 Drawing Sheets

(56) References Cited

U.S. PATENT DOCUMENTS

| | | | | |
|---|---|---|---|---|
| 9,091,117 | B2 * | 7/2015 | Ng | E06B 9/42 |
| 9,677,583 | B1 * | 6/2017 | Wong | F16M 13/02 |
| 10,508,491 | B2 * | 12/2019 | Huang | E06B 9/324 |
| 2013/0233500 | A1 * | 9/2013 | Chen | A47H 3/10 160/370 |
| 2014/0374038 | A1 * | 12/2014 | Chen | E06B 9/262 160/370 |
| 2015/0159431 | A1 * | 6/2015 | Kao | A47H 5/02 24/116 A |

* cited by examiner

BEAD CHAIN OR CORD RETAINER

BACKGROUND OF THE INVENTION

Field of the Invention

The present invention relates to a bead chain or cord retainer, especially to a bead chain or cord retainer which prevents the bead chain or cord from tangling and further avoids accidental strangulation.

Description of Related Art

A curtain body of curtains is open or closed manually by pulling a control rope such as a cord or a bead chain beside the curtain body. When the control rope is not fixed, it is laid down naturally beside the curtain body and located close to windows. When wind blows, the control rope moves with the winds to hit window sides or walls and make annoying noises. Moreover, the dangling control rope may catch surrounding objects so that the objects come off and get damaged. The hanging control rope may attract curious children to play, and even worse, put the cord around their necks to have fall accidents or choking hazards.

In order to solve the shortcomings of the control rope mentioned above, applicants have developed a plurality of retainers. Refer to Taiwanese Pat. No. M649476, the design of the retainer ensures a cord mounted in a winding space of the retainer is fixed, without sliding off the winding space. Refer to Taiwanese Pat. No. M415669, a bead chain and a cord are respectively secured in a first fixing hole and a second fixing hole of the retainer. Thus the bead chain and the cord will not get tangled with each other to make children safe while playing near the hanging bead chain or cord. Refer to Taiwanese Pat. No. M470616, a cord and bead chain used to control on/off and turning of curtains are positioned firmly by the retainer. Thus the cord and bead chain will not become loose or get dangling or tangled for children's safety.

Thus there is room for improvement and there is a need to provide a novel retainer in order to address safety issues mentioned above and meet latest safety norms.

SUMMARY OF THE INVENTION

Therefore, it is a primary object of the present invention to provide a bead chain or cord retainer used to hold and position the bead chains or cords for convenience of mounting the retainer to walls before installation. While being mounted to the wall, the retainer keeps the bead chain or the cord straight property, without being tangled. Thus the bead chain or the cord can be drawn smoothly within a passage formed in the retainer to open or close curtains.

In order to achieve the above object, a bead chain or cord retainer according to the present invention includes a frame, a moving part, and an elastic member.

The frame consists of a first wall, a second wall disposed opposite to the first wall, a third wall connected between one side of the first wall and one side of the second wall, and a space penetrating vertically and defined by the first wall, the second wall, and the third wall. A limit rod is disposed between the first wall and the second wall and across the space. A through hole is mounted to the third wall.

The moving part is composed of a first vertical wall, a second vertical wall, a connection segment connected between a top of the first vertical wall and a top of the second vertical wall, a passage penetrating horizontally and defined by the first vertical wall, the second vertical wall, and the connection segment, an extension segment disposed on a bottom of the first vertical wall and extending toward the second vertical wall, and an insertion hole mounted close to a bottom of the second vertical wall. The passage allows the bead chain or the cord to insert through. By the connection segment of the moving part aligned with the limit rod of the frame, the first vertical wall and the second vertical wall are mounted into the space of the frame and a part of the passage is located between the first wall and the second wall.

The elastic member is installed between the limit rod and the extension segment for allowing the moving part to be elastically mounted in the space and a changing area of the passage is located between the first wall and the second wall to clip or release the bead chain or the cord.

Preferably, an upper surface of the limit rod is a toothed surface.

Preferably, a lower surface of the limit rod is provided with a bulging block projecting toward the extension segment. A bump is arranged at an upper surface of the extension segment and projecting toward the limit rod. Two ends of the elastic member are fitted to the bulging block and the bump correspondingly for positioning.

Preferably, a cover plate is vertically movable and disposed between another side of the first wall away from the side of the first wall connected with the third wall and another side of the second wall away from the side of the second wall connected with the third wall. The cover plate is arranged opposite to the third wall. The side of the first wall away from the third wall and the side of the second wall away from the third wall are both provided with a joining edge. The cover plate includes two joining steps disposed on two sides of the cover plate and joined with the two joining edges correspondingly.

Preferably, the side of the first wall away from the third wall and the side of the second wall away from the third wall are both provided with locking holes. Each of the two sides of the cover plate is provided with locking blocks corresponding to the locking holes. The locking blocks can be mounted into the locking holes correspondingly.

Preferably, a limit block is arranged at an outer surface of the second vertical wall of the moving part away from the first vertical wall and an opening is disposed on the third wall of the frame. When the moving part is not lifted, the limit block is mounted in the opening correspondingly. After the moving part being lifted and the insertion hole aligned with the through hole, the limit block is just abutting against an upper edge of the third wall.

Preferably, a positioning member is inserted into the insertion hole of the moving part. The positioning member consists of an insertion pin and a limiting piece integrally connected with one end of the insertion pin and provided with limiting edges on a periphery of the limiting piece. After the frame, the moving part, the elastic member, and the bead chain or the cord being assembled completely and the insertion pin of the positioning member being inserted into the insertion hole of the moving part, the limiting edge of the limiting piece is in contact with and abutting against a lower edge of the third wall of the frame.

Preferably, the two limiting edges on the periphery of the limiting piece have different abutting levels each of which is defined as a distance between an axis of the insertion pin and the limiting edge.

Preferably, a truncated conical tenon is disposed on one end of the insertion pin away from the limiting pieces. At least one notch is axially mounted to the insertion pin from the end of the insertion pin connected with the truncated conical tenon.

Preferably, a plurality of positioning grooves is arranged at a top side, a bottom side, a left side, and a right side of a surface of the insertion hole correspondingly. An outer surface of the insertion pin of the positioning member is provided with at least one locking strip disposed axially. A relative position of the positioning member with respect to the insertion hole is fixed when the locking strip is mounted into one of the positioning grooves correspondingly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
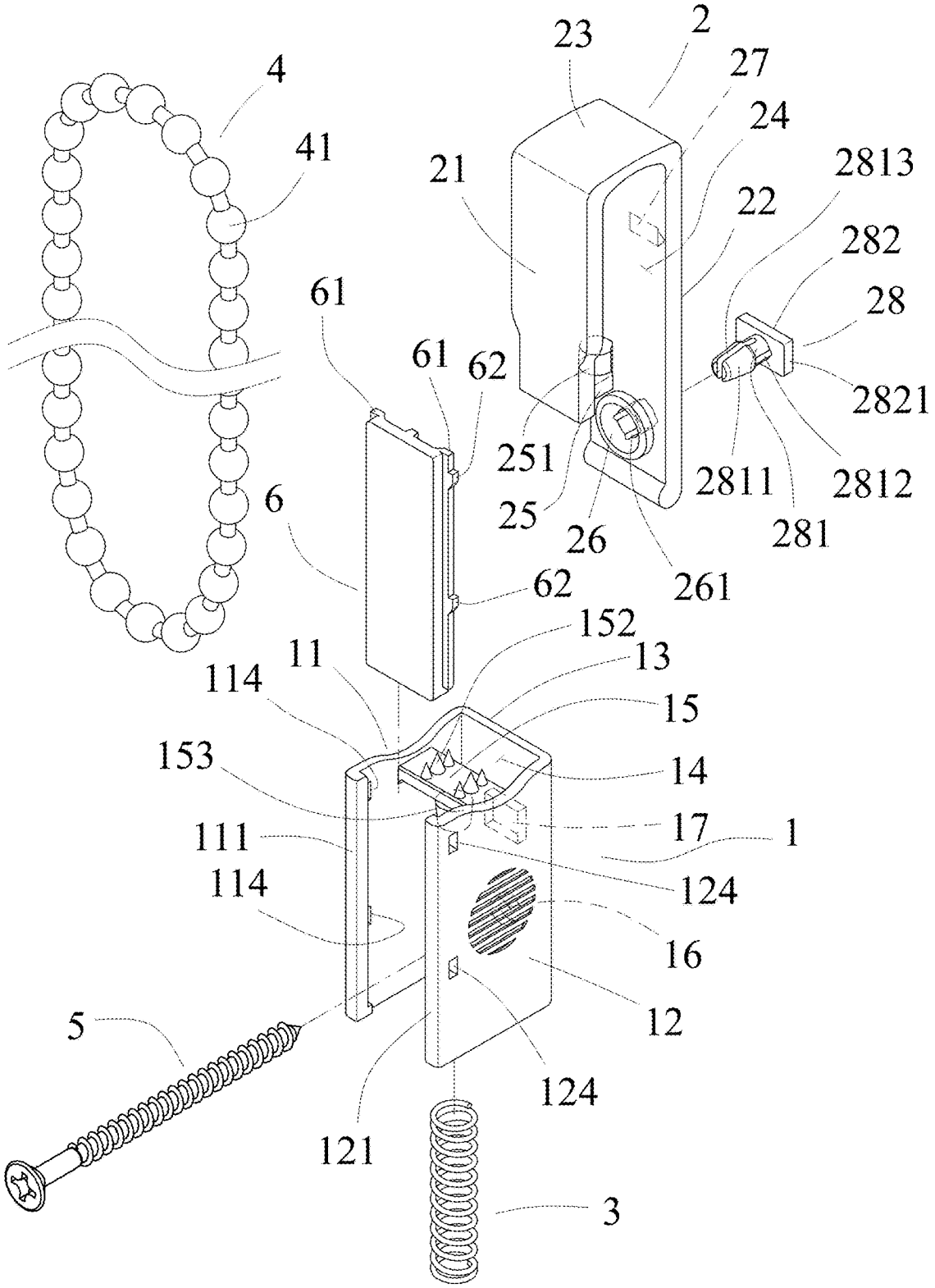
FIG. 1 is an exploded view of an embodiment according to the present invention.

Refer to FIG. 1-4, a bead chain or cord retainer according to the present invention includes a frame 1, a moving part 2, and an elastic member 3.

The frame 1 consists of a first wall 11, a second wall 12 disposed opposite to the first wall 11, a third wall 13 used for connecting one side of the first wall 11 and one side of the second wall 12, a space 14 penetrating vertically and defined by the first wall 11, the second wall 12, and the third wall 13, a limit rod 15 disposed between the first wall and 11 the second wall 12 and across the space 14, and a through hole 16 mounted to the third wall 13.

The moving part 2 is composed of a first vertical wall 21, a second vertical wall 22, a connection segment 23 connected between a top of the first vertical wall 21 and a top of the second vertical wall 22, a passage 24 penetrating horizontally and defined by the first vertical wall 21, the second vertical wall 22, and the connection segment 23, an extension segment 25 disposed on a bottom of the first vertical wall 21 and extending toward the second vertical wall 22, and an insertion hole 26 mounted close to a bottom of the second vertical wall 22. The passage 24 allows a bead chain or a cord 4 to insert through. By the connection segment 23 of the moving part 2 aligned with the limit rod 15 of the frame 1, the first vertical wall 21 and the second vertical wall 22 are inserted and mounted in the space 14 of the frame 1 and a part of the passage 24 is located between the first wall 11 and the second wall 12. Another part of the passage 24 not located between the first wall 11 and the second wall 12 forming a clipped and limited space for clipping and limiting the bead chain or the cord 4.

Figure 2:
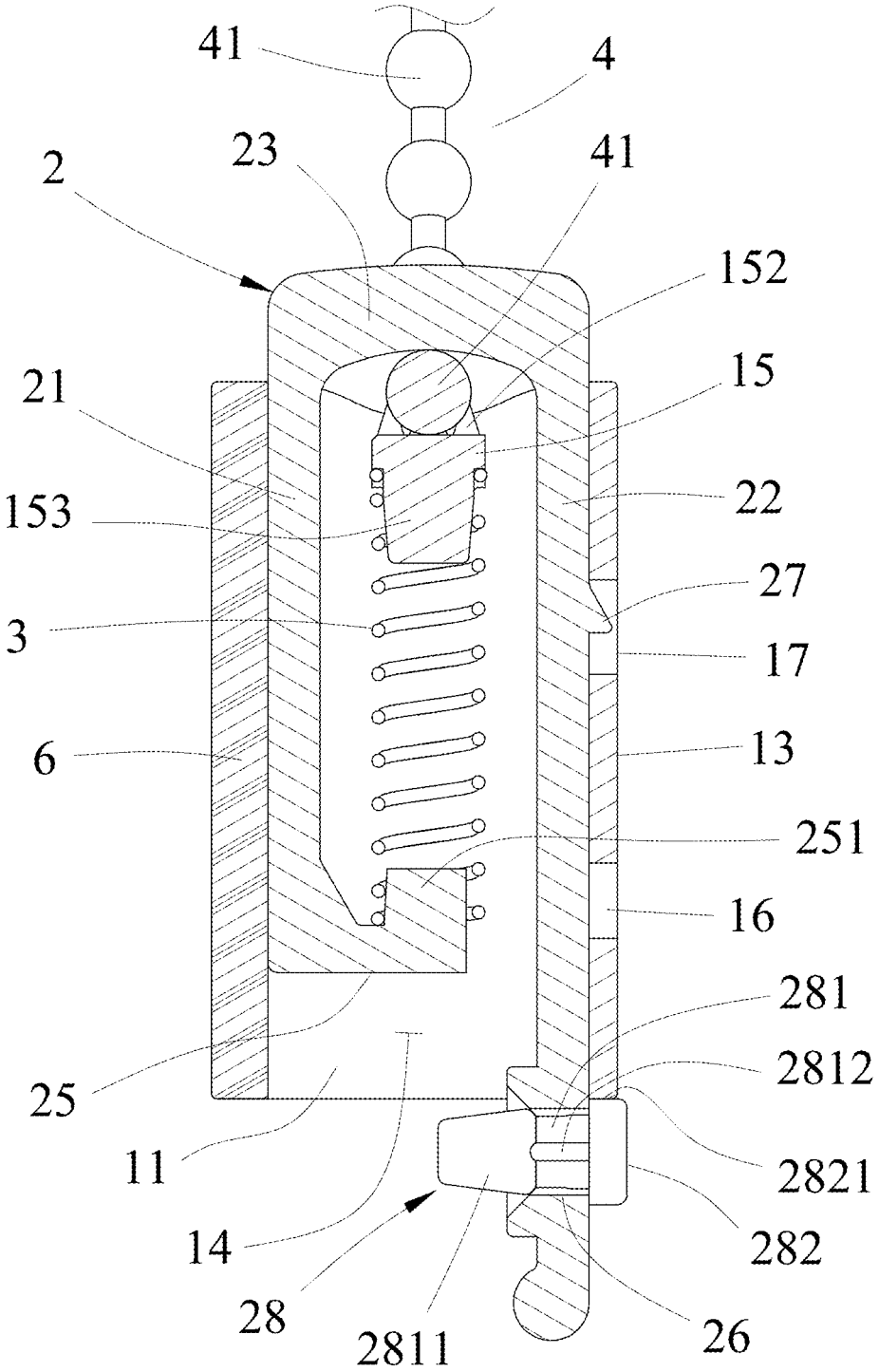
FIG. 2 is a side sectional view of an embodiment assembled with a bead chain according to the present invention.

As shown in FIG. 2, the elastic member 3 is installed between the limit rod 15 of the frame 1 and the extension segment 25 of the moving part 2 for allowing the moving part 2 to be elastically mounted in the space 14 of the frame 1. Generally, the frame 1 and the moving part 2 are abutted against by the elastic member 3 so that the clipped and limited space formed by the frame 1 and the moving part 2 is restricted. Now the bead chain or the cord 4 is clipped and limited between an upper surface of the limit rod 15 of the frame 1 and an inner surface of the connection segment 23 of the moving part 2. Under such state, the bead chain or the cord 4 is held and fixed, unable to be pulled. When the moving part 2 is lifted to compress the elastic member 3, the clipped and limited space formed by the frame 1 and the moving part 2 is expanded. At the moment, the bead chain or the cord 4 is no more clipped and limited between the upper surface of the limit rod 15 of the frame 1 and the inner surface of the connection segment 23 of the moving part 2, changed into a released/loose state. That means the bead chain or the cord 4 can be clipped or released by changing an area size of the passage 24 located between the first wall 11 and the second wall 12.

Figure 5:
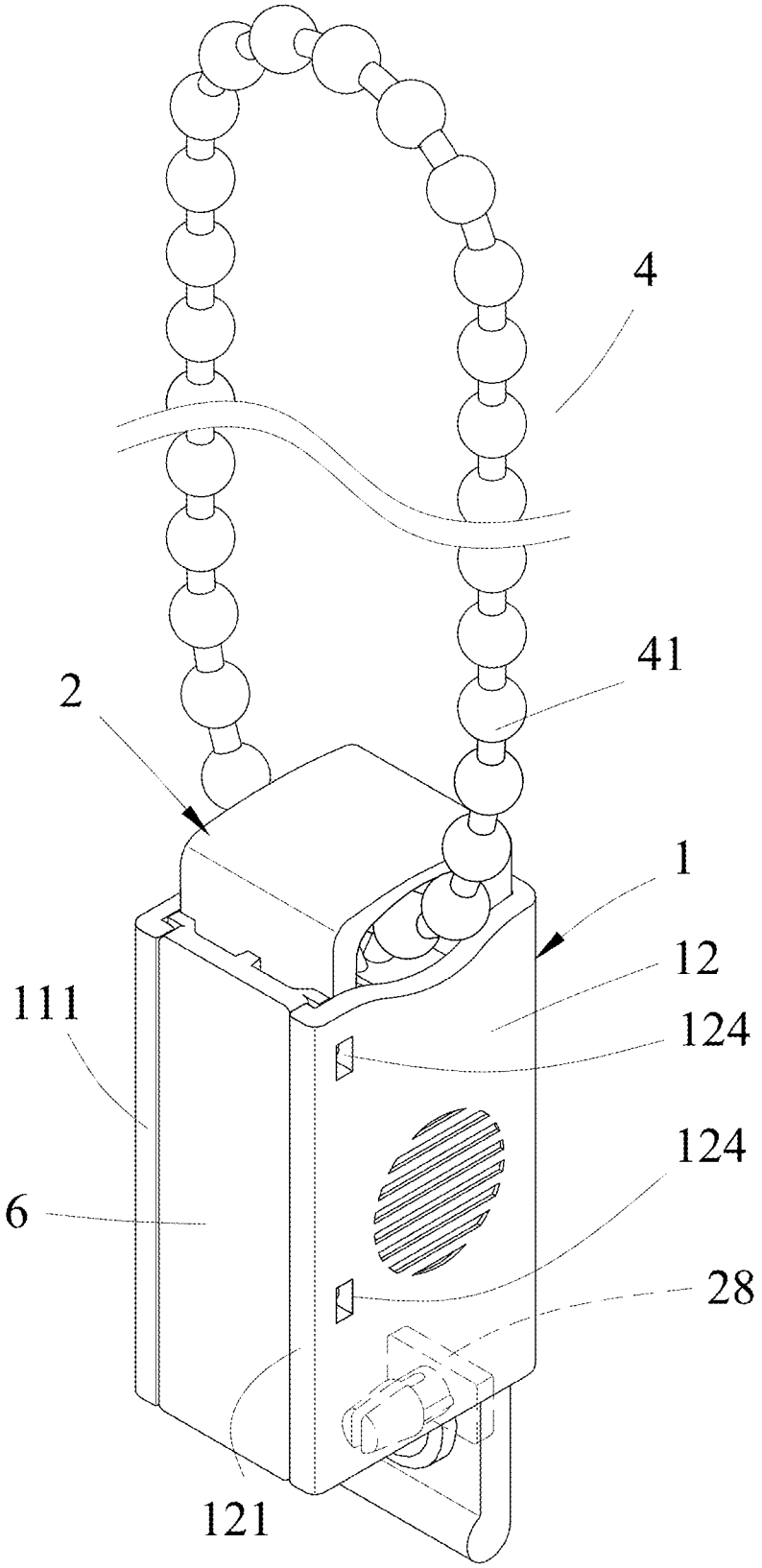
FIG. 5 is a perspective view of an embodiment with a bead chain in a clipped and limited state according to the present invention.
Figure 6:
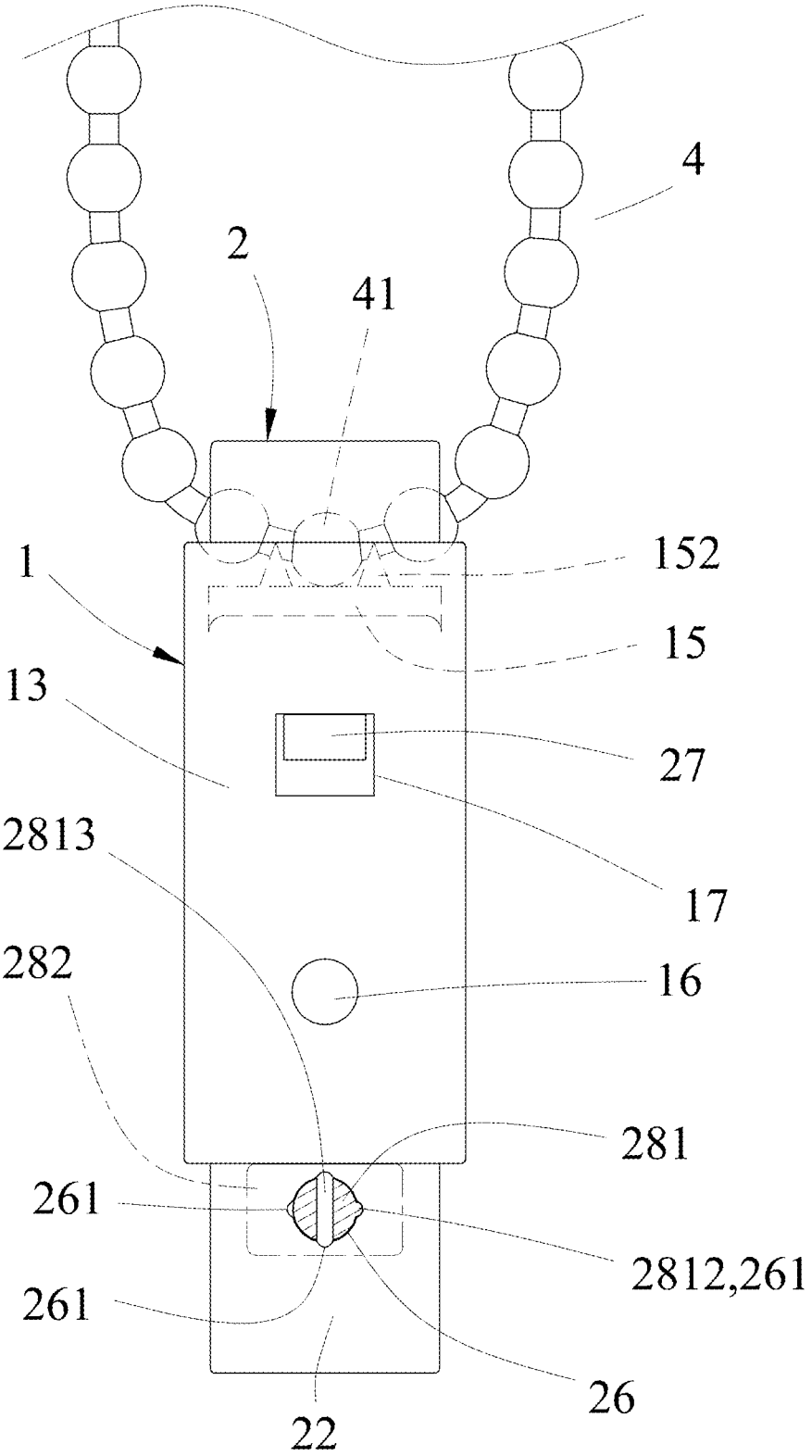
FIG. 6 is a back view of an embodiment with a bead chain in a clipped and limited state according to the present invention.
Figure 7:
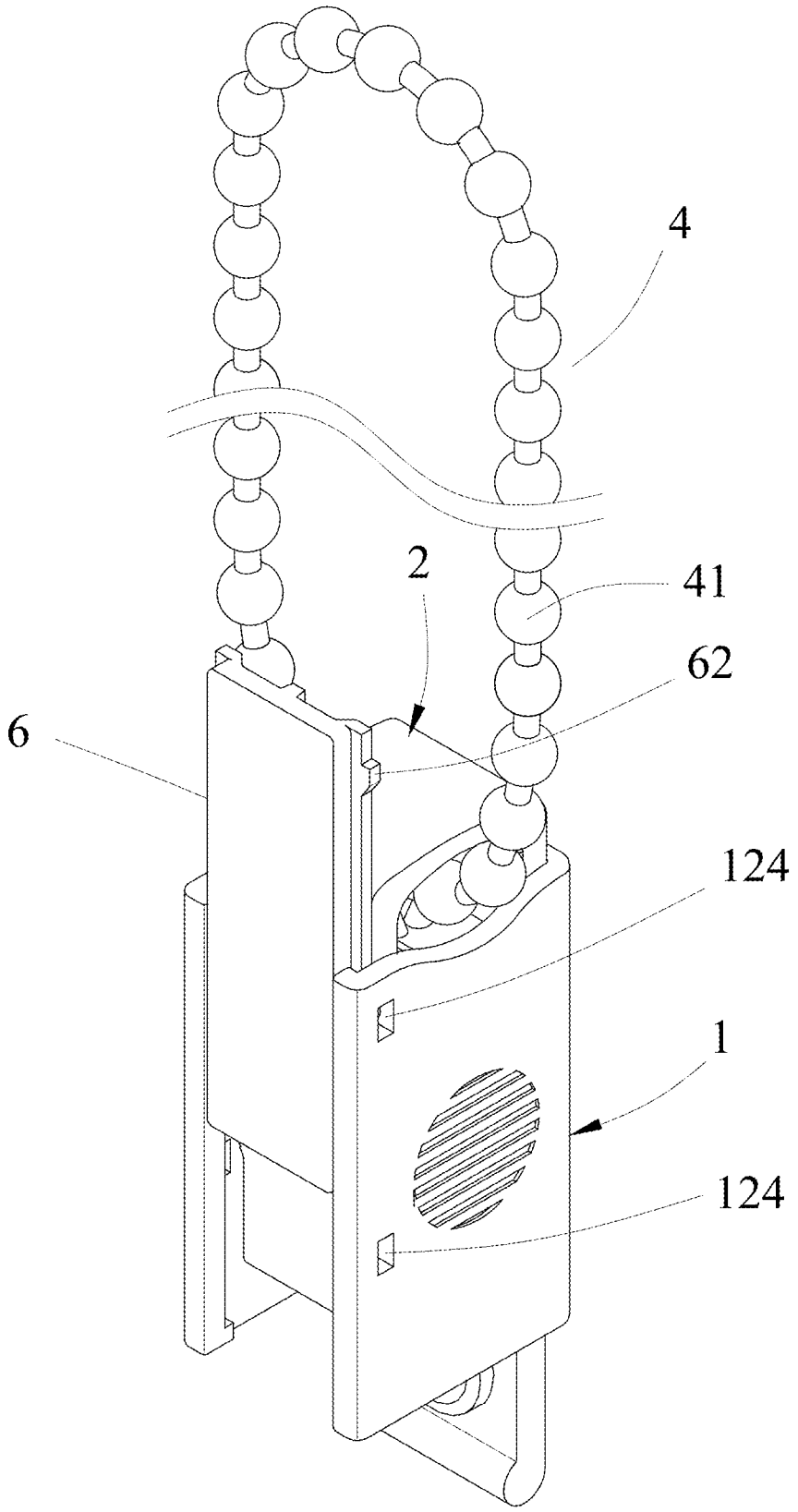
FIG. 7 is a perspective view of an embodiment showing a cover plate is lifted when a bead chain in a clipped and limited state according to the present invention.
Figure 8:
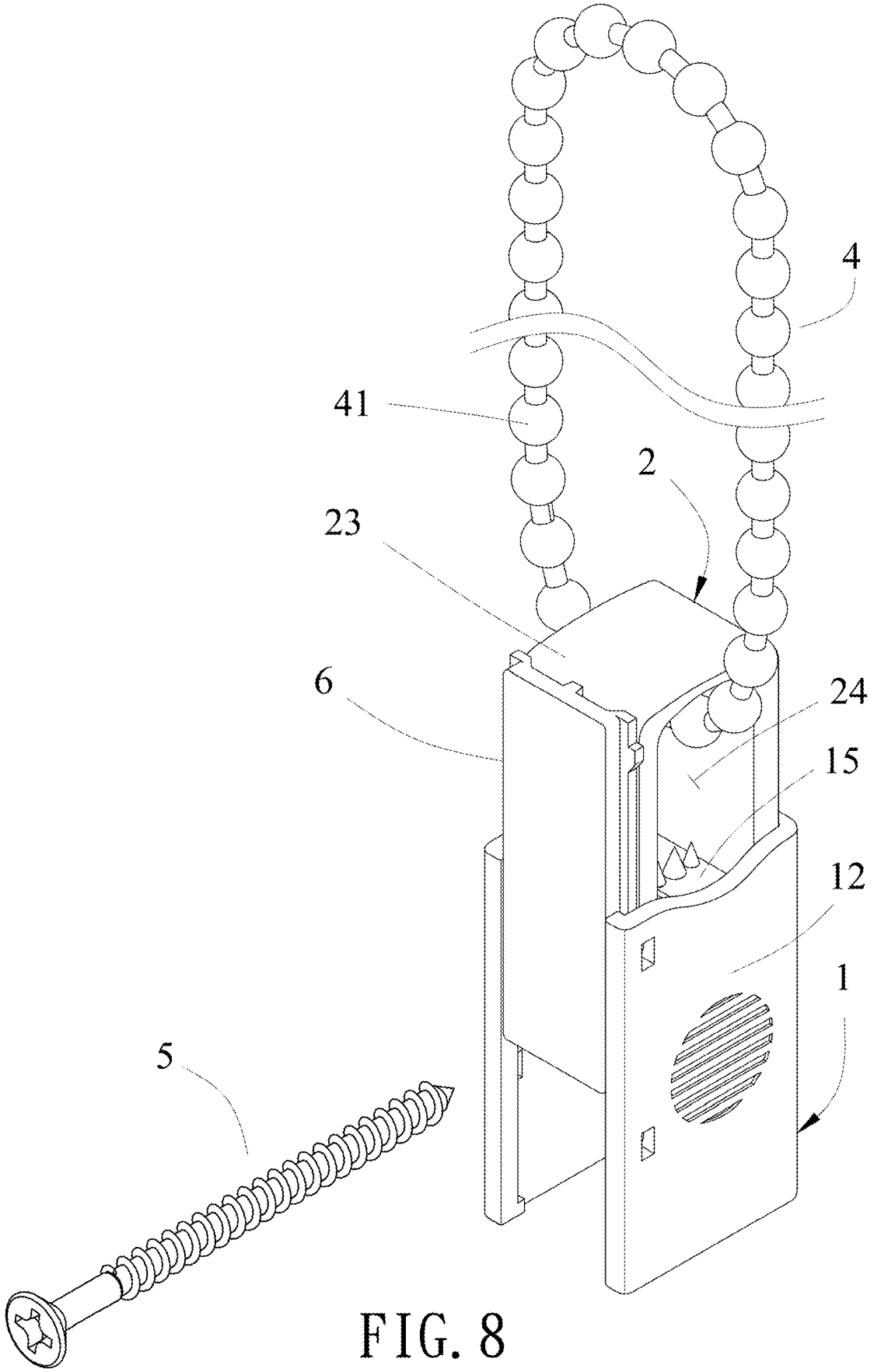
FIG. 8 is a perspective view showing an upward-moved cover plate, a lifted moving part, and a fastener going to be inserted through an embodiment according to the present invention.

Thereby while mounting the bead chain or the cord 4 to a curtain controller (not shown in figures), the clipped and limited space formed by the frame 1 and the moving part 2 is restricted because that the elastic member 3 is abutting against both the frame 1 and the moving part 2. Thus the bead chain or the cord 4 is clipped and positioned between the upper surface of the limit rod 15 of the frame 1 and the inner surface of the connection segment 23 of the moving part 2 (as shown in FIG. 2, FIG. 5, and FIG. 6). Thus a relative position of the bead chain or the cord 4 with respect to the retainer is fixed and this helps to measure the position of the retainer being mounted on a wall easily.

Figure 9:
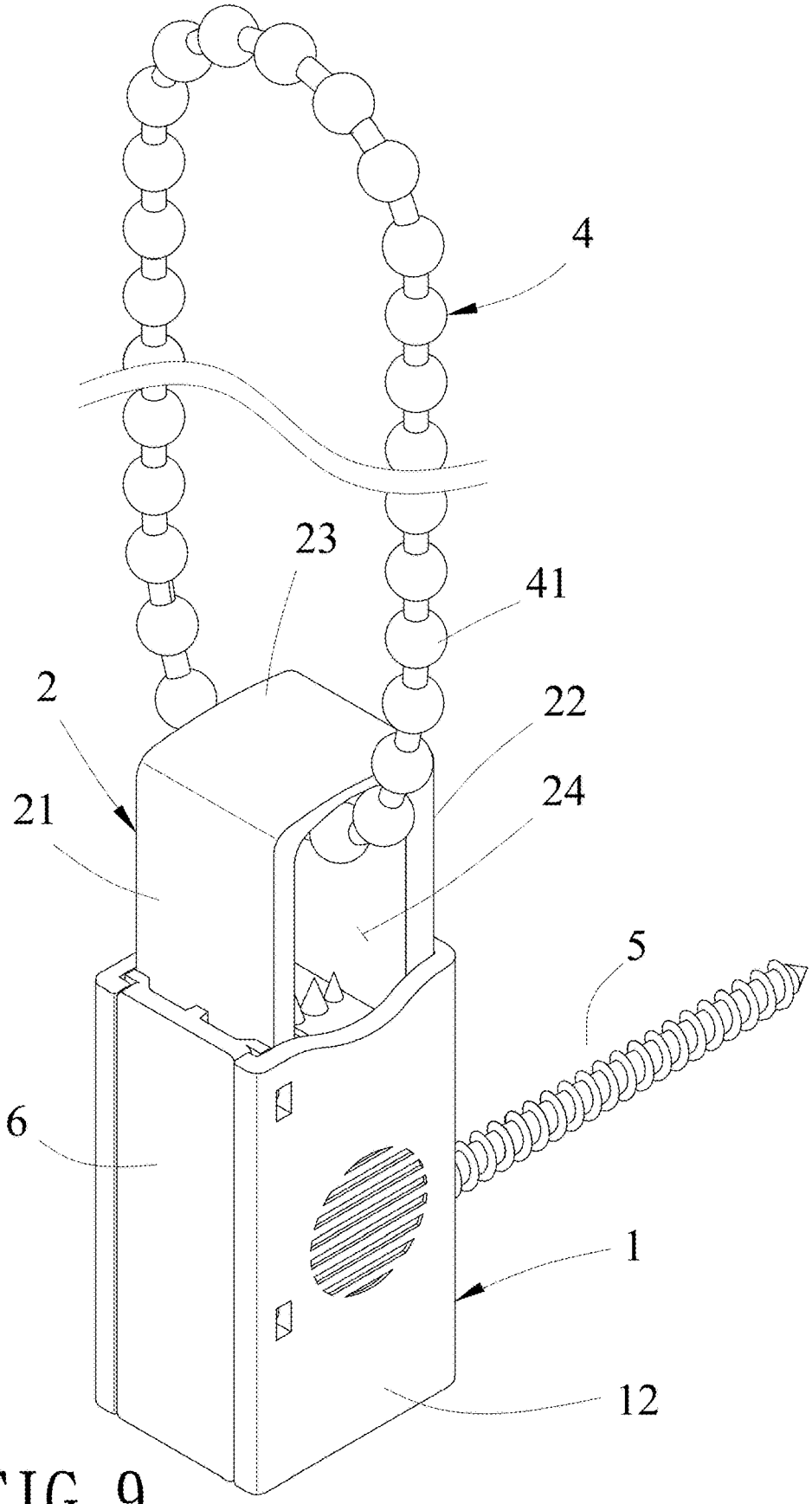
FIG. 9 is a perspective view showing a moving part fixed on a lifted position by a fastener being inserted through in order to release a bead chain and move a cover plate downward of an embodiment according to the present invention.
Figure 10:
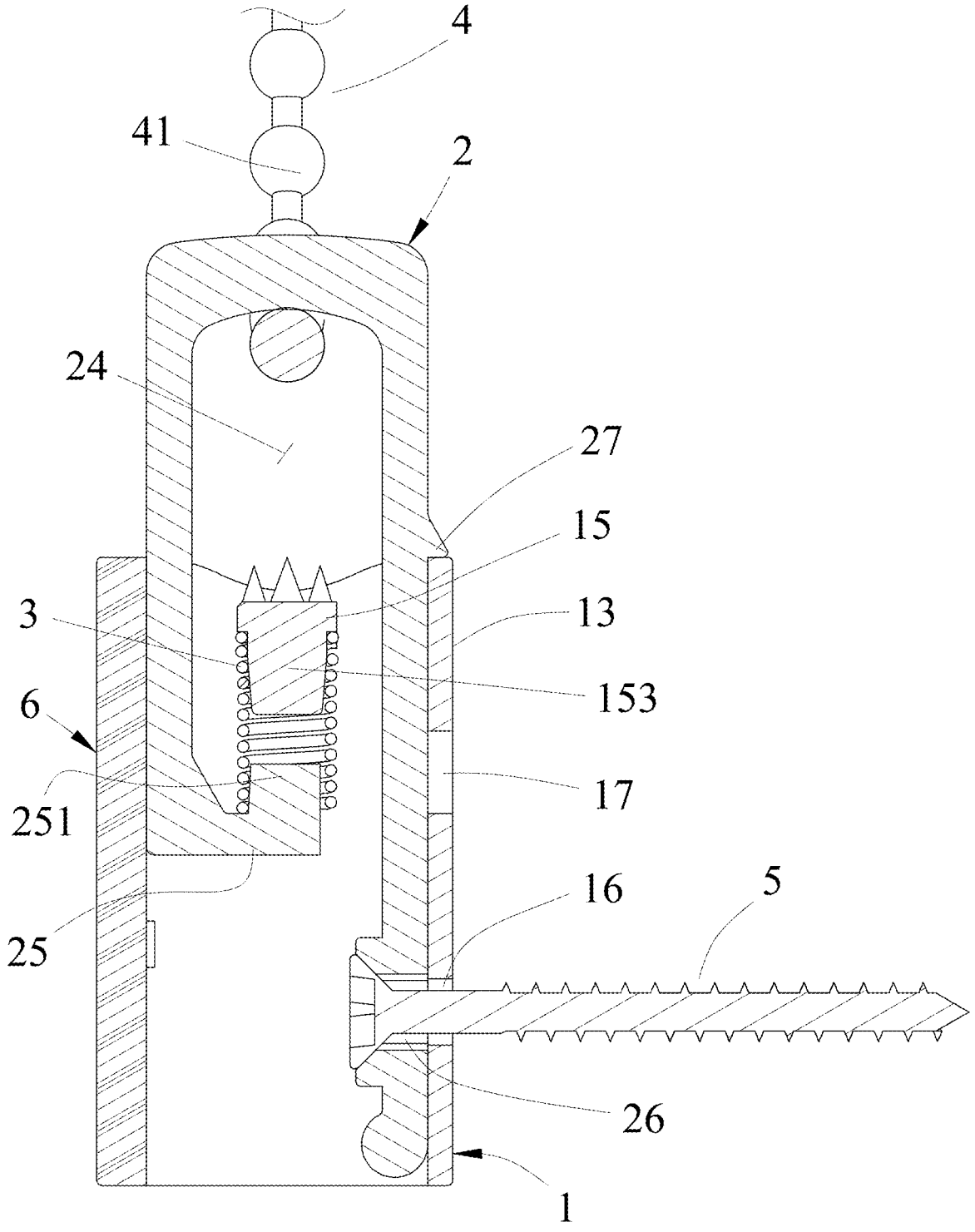
FIG. 10 is a sectional view showing a moving part fixed on a lifted position by a fastener being inserted through in order to release a bead chain and move a cover plate downward of an embodiment according to the present invention.
Figure 11:
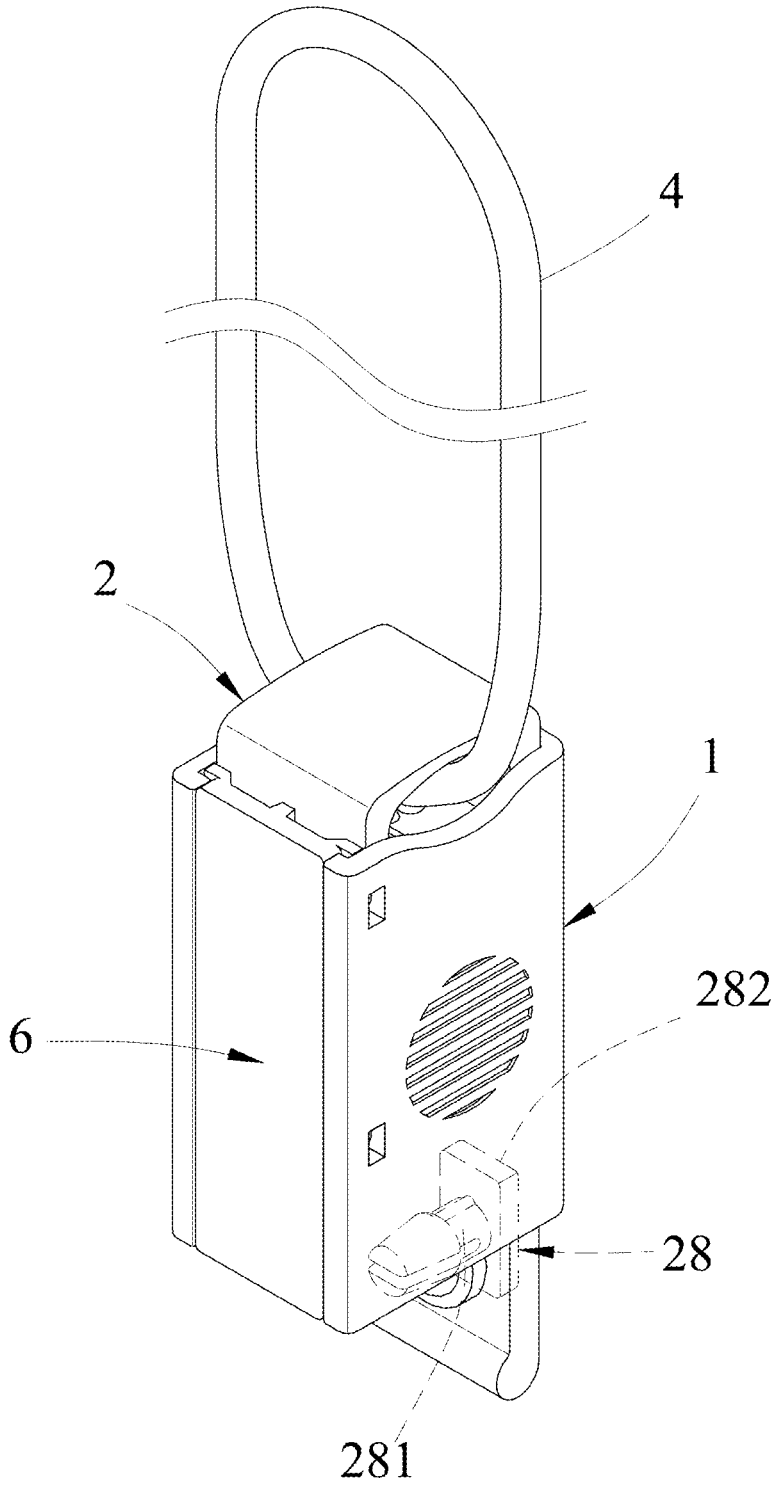
FIG. 11 is a perspective view of a cord clipped by an embodiment according to the present invention.

Refer to FIG. 7-10, after confirming the position of the retainer being mounted on the wall, the moving part 2 is pushed to move upward until the insertion hole 26 on the second vertical wall 22 of the moving part 2 is aligned with the through hole 16 on the third wall 13 of the frame 1. Then a fastener 5 is inserted through the insertion hole 26 and the through hole 16 to be threaded into the wall so that the retainer is fixed on the wall. At the moment, the moving part 2 is fixed on a lifted state so that the clipped and limited space formed by the frame 1 and the moving part 2 is expanded. That means the bead chain or the cord 4 is no more clipped and limited between the upper surface of the limit rod 15 of the frame 1 and the inner surface of the connection segment 23 of the moving part 2, being in a released/loose state (as shown in FIG. 9 and FIG. 10). Under such state, the bead chain or the cord 4 is only able to be operated and movable within the passage 24 formed by the frame 1 and the moving part 2. Thereby users open or close window curtains by drawing the bead chain or the cord 4.

Figure 15:
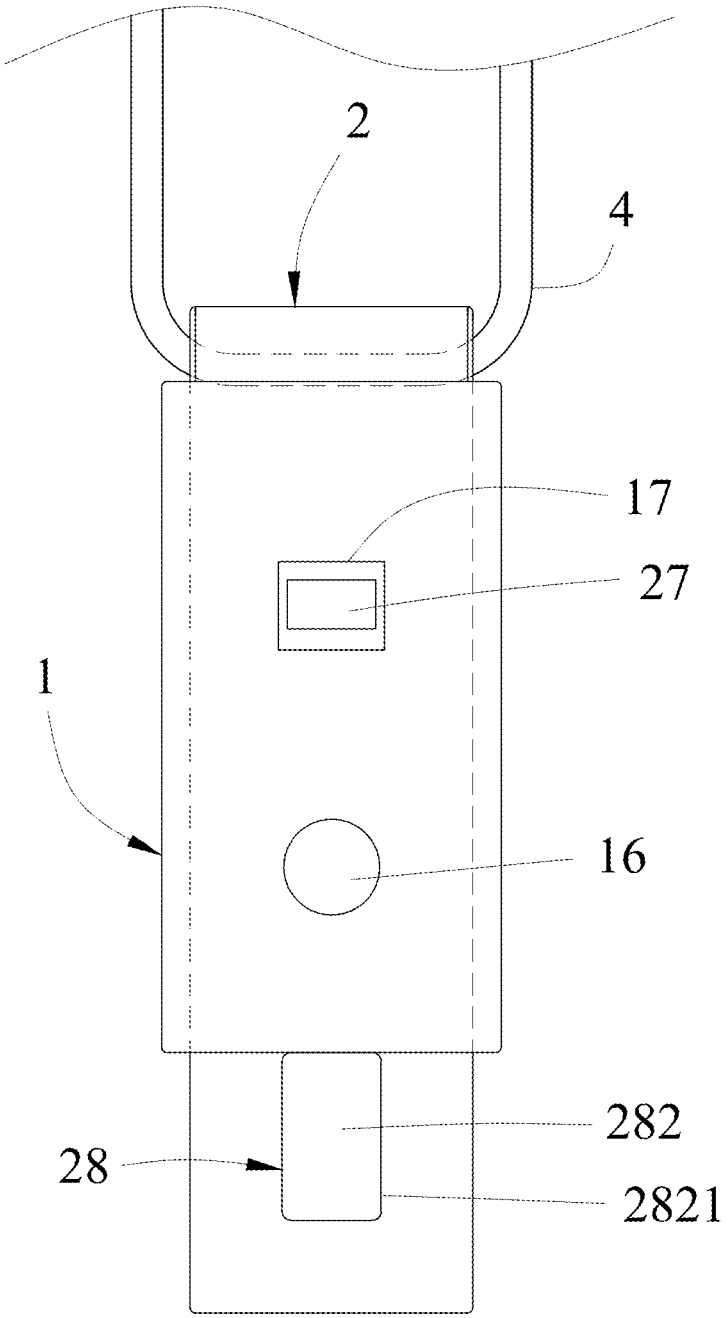
FIG. 15 is a rear view showing another embodiment in which a cord is clipped and limited according to the present invention.

In a preferred embodiment of the present invention, a positioning member 28 is inserted into the insertion hole 26 of the moving part 2 in order to ensure that the bead chain or the cord 4 is clipped and positioned between the upper surface of the limit rod 15 of the frame 1 and the inner surface of the connection segment 23 of the moving part 2 (as shown in FIG. 1, FIG. 2, and FIG. 6). The positioning member 28 consists of an insertion pin 281 and a limiting piece 282 integrally connected with one end of the insertion pin 281 and provided with at least two limiting edges 2821 on a periphery of the limiting piece 282. After the frame 1, the moving part 2, the elastic member 3, and the bead chain or the cord 4 being assembled and the insertion pin 281 of the positioning member 28 being inserted into the insertion hole 26 of the moving part 2, the limiting edge 2821 of the limiting piece 282 of the positioning member 28 is in contact with and abutting against a lower edge of the third wall 13 of the frame 1 so that relative positions of the frame 1 and the moving part 2 with respect to each other are fixed securely. And the bead chain or the cord 4 is further secured firmly by the retainer. The two limiting edges 2821 have different abutting levels each of which is defined as a distance between an axis of the insertion pin 281 and the respective limiting edges 2821. Refer to FIG. 1, FIG. 5, FIG. 6, and FIG. 11-14, the limiting piece 282 is a rectangle and a distance between the axis of the insertion pin 281 and a long side of the rectangle is shorter than a distance between the axis of the insertion pin 281 and a short side of the rectangle so that there two levels formed, a lower abutting level and a higher abutting level. According to an outer diameter of the bead chain or the cord 4 inserted through the clipped and limited space between the frame 1 and the moving part 2, the positioning member 28 is rotated to allow the short side or long side of the rectangle of the positioning member 28 abutting against the lower edge of the third wall 13 of the frame 1. A size of the clipped and limited space can be adjusted by switching between the lower abutting level and the higher abutting level in response to the different outer diameters of the bead chain or the cord 4. For example, refer to FIG. 11, FIG. 12, and FIG. 15, the limiting piece 282 is in a higher-abutting-level state. That means the positioning member 28 is in contact with and abutting against the lower edge of the third wall 13 of the frame 1 by the short side of the rectangle. Thus the clipped and limited space formed between the frame 1 and the moving part 2 is more compressed in response to the cord 4 with a smaller outer diameter. Refer to FIG. 2, FIG. 5, FIG. 6, and FIG. 14, the limiting piece 282 is in a lower-abutting-level state. That means the positioning member 28 is in contact with and abutting against the lower edge of the third wall 13 of the frame 1 by the long side of the rectangle. Thus the clipped and limited space formed between the frame 1 and the moving part 2 is a bit larger relatively in response to the bead chain 4 with a larger outer diameter. No matter the limiting piece 282 of the positioning member 28 is in the lower-abutting-level state or the higher-abutting-level state, the positioning member 28 is used for allowing the bead chain or the cord 4 to be locked in the retainer firmly, without being able to be pulled when the retainer is not mounted to the wall yet. Thereby safety requirements are met. In a preferred embodiment, the positioning member 28 can be removed only by tools.

In a preferred embodiment, in order to ensure the positioning member 28 and the insertion hole 26 mounted with each other securely and the positioning member 28 is unable to be released from the insertion hole 26 easily, a truncated conical tenon 2811 is disposed on one end of the insertion pin 281 of the positioning member 28 away from the limiting pieces 282. At least one notch 2813 is axially mounted to the insertion pin 281 from the end of the insertion pin 281 connected with the truncated conical tenon 2811 to make the truncated conical tenon 2811 have elasticity by which the truncated conical tenon 2811 is able to be inserted through the insertion hole 26 and turned back to the original shape after being inserted through the insertion hole 26. Thereby the positioning member 28 will not be released from the insertion hole 26 easily. When the user intends to release the positioning member 28 from the insertion hole 26, the truncated conical tenon 2811 is compressed due to the notch 2813 in the axial direction of the insertion pin 281 and released from the insertion hole 26. Then the positioning member 28 is removed from the insertion hole 26.

Figure 12:
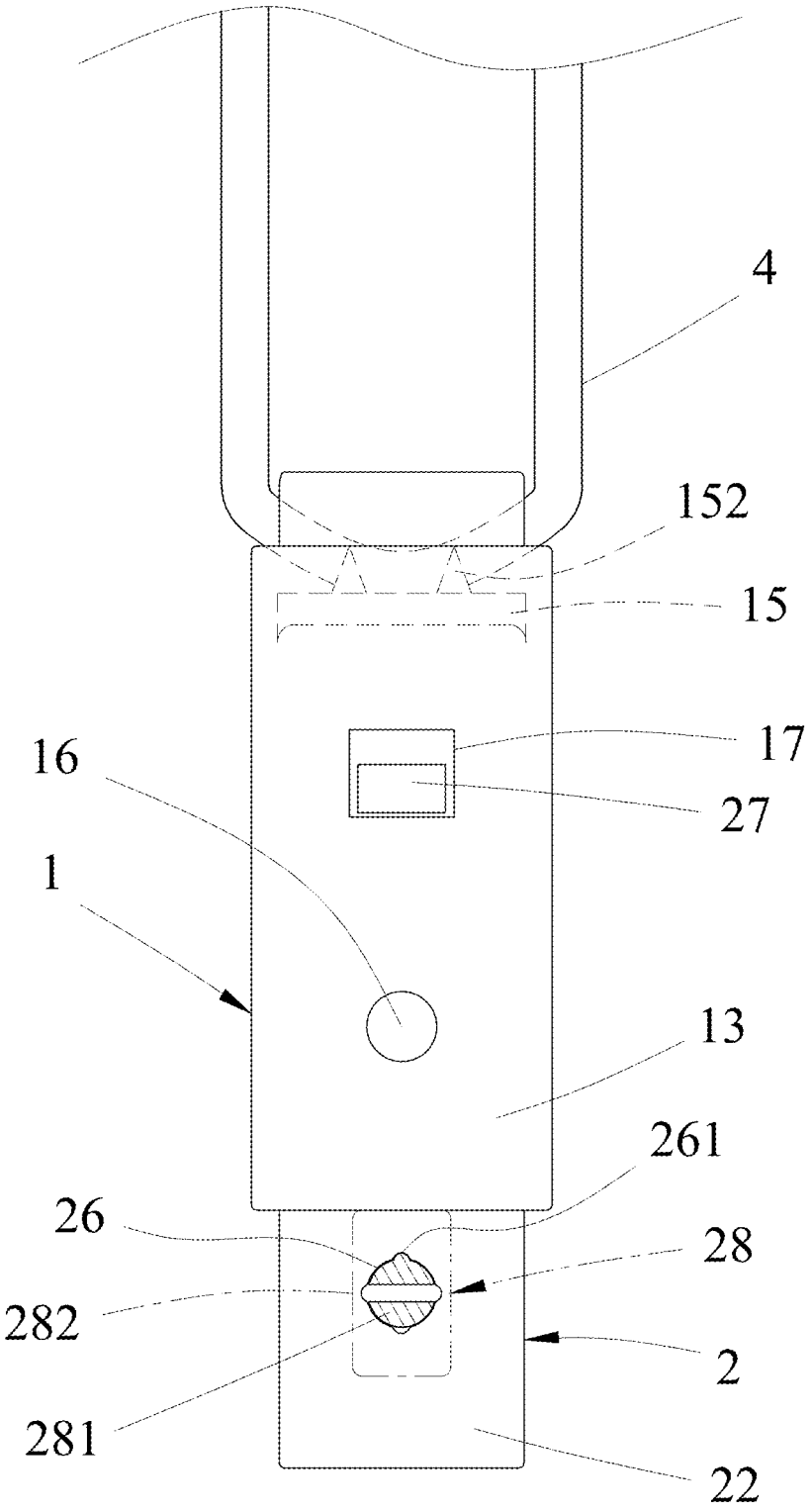
FIG. 12 is a rear view of a cord clipped by an embodiment according to the present invention.
Figure 13:
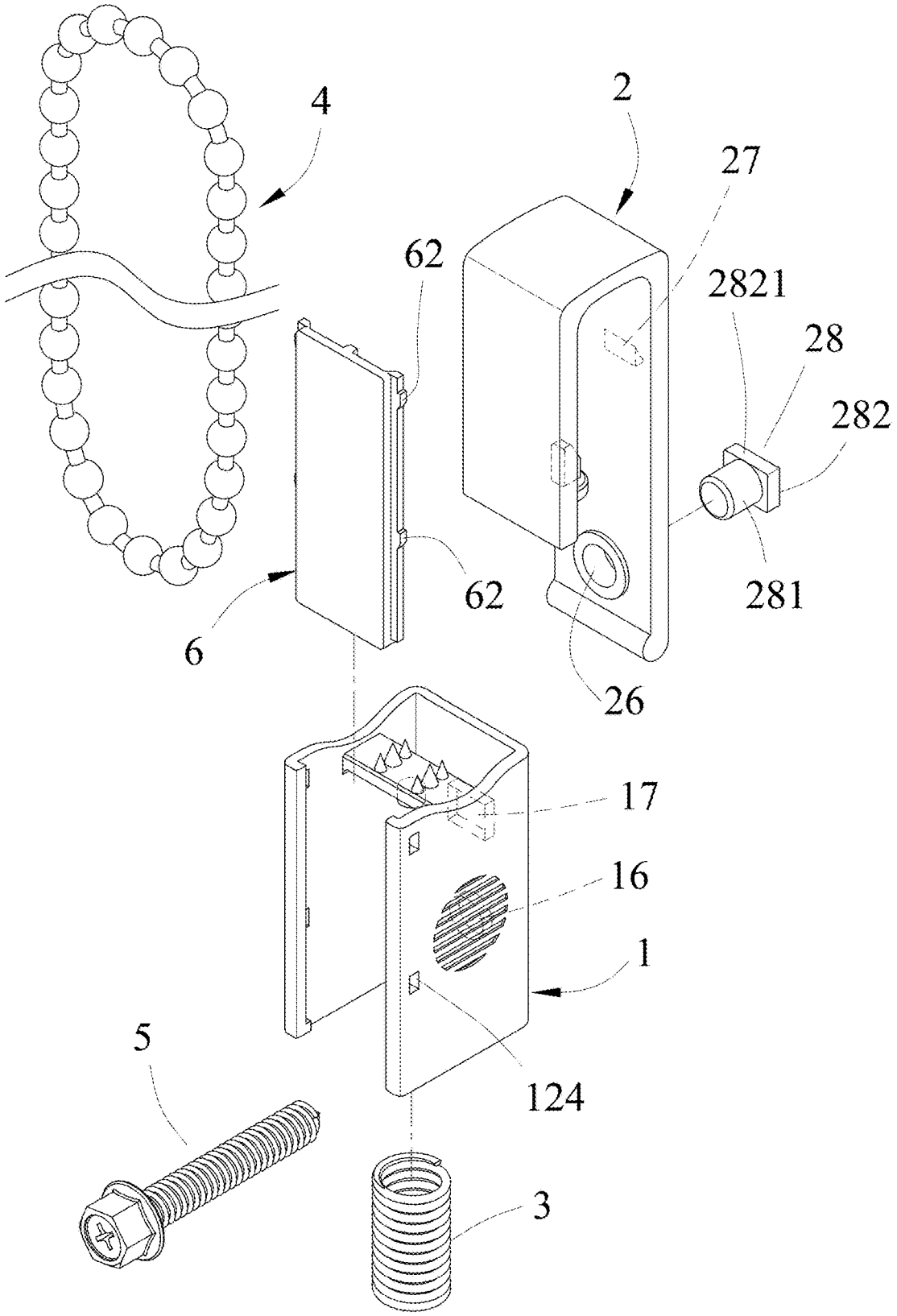
FIG. 13 is an exploded view showing another embodiment with a positioning member according to the present invention.
Figure 14:
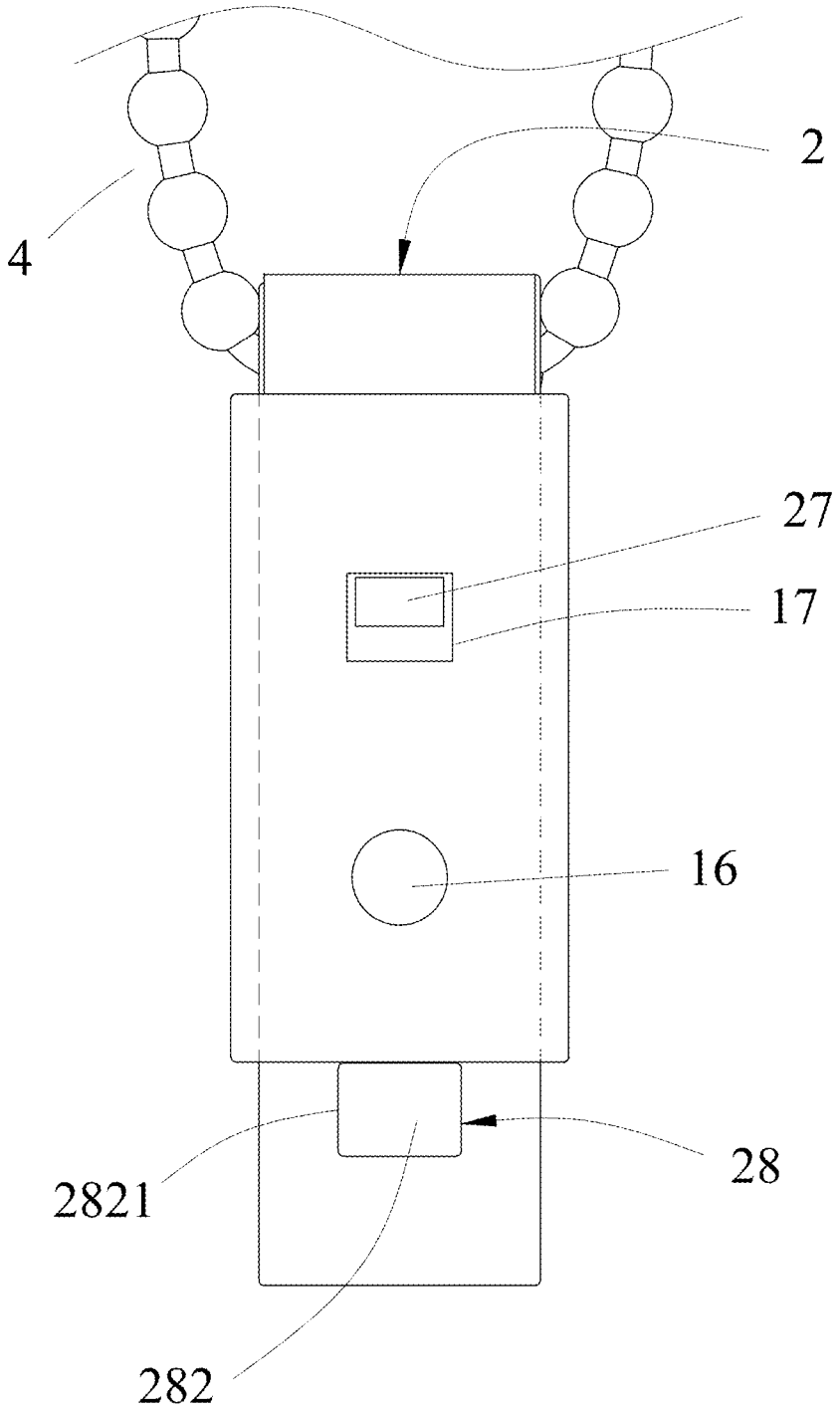
FIG. 14 is a rear view showing another embodiment in which a bead chain is clipped and limited according to the present invention.

In a preferred embodiment, a surface of the insertion hole 26 is provided with a plurality of positioning grooves 261 arranged at top, bottom, left, and right sides of the surface of the insertion hole 26 correspondingly as shown in FIG. 1, FIG. 6, and FIG. 12. An outer surface of the insertion pin 281 of the positioning member 28 is provided with at least one locking strip 2812 disposed axially. When the locking strip 2812 is mounted into one of the positioning grooves 261 correspondingly, a relative position of the positioning member 28 with respect to the insertion hole 26 is fixed. Thereby the positioning member 28 is positioned after the limiting piece 282 of the positioning member 28 being adjusted to the lower-abutting-level state or the higher-abutting-level state.

In a preferred embodiment, the upper surface of the limit rod 15 is designed into a toothed surface 152 (as shown in FIG. 1) which increases a clipping force the limit rod 15 of the frame 1 and the connection segment 23 of the moving part 2 applied to the bead chain or the cord 4. Thus the bead chain or the cord 4 will not slide and move easily while being clipped. Especially when the bead chain 4 is used, beads 41 each of which is just mounted between two adjacent teeth of the toothed surface 152 in combination with the connection segment 23 of the moving part 2 can provide good clipping and limiting effect.

In a preferred embodiment, a lower surface of the limit rod 15 is provided with a bulging block 153 projecting toward the extension segment 25 of the moving part 2 when the frame 1 and the moving part 2 are assembled with each other (refer to FIG. 1 and FIG. 2). A bump 251 is arranged at an upper surface of the extension segment 25 of the moving part 2 and projecting toward the limit rod 15 of the frame 1. Two ends of the elastic member 3 are fitted to the bulging block 153 and the bump 251 correspondingly to be positioned.

In a preferred embodiment, a bead chain or cord retainer further includes a cover plate 6. Refer to FIG. 1-4, the cover plate 6 is vertically movable and disposed between another side of the first wall 11 and another side of the second wall 12, which are respectively away from the side of the first wall 11 connected with the third wall 13 and the side of the second wall 12 connected with the third wall 13. The cover plate 6 is arranged opposite to the third wall 13. The side of the first wall 11 away from the third wall 13 and the side of the second wall 12 away from the third wall 13 are respectively provided with a joining edge 111 and a joining edge 121. The cover plate 6 includes two joining steps 61. The joining steps 61 are disposed on two sides of the cover plate 6 and joined with the two joining edges 111, 121 correspondingly.

Figure 3:
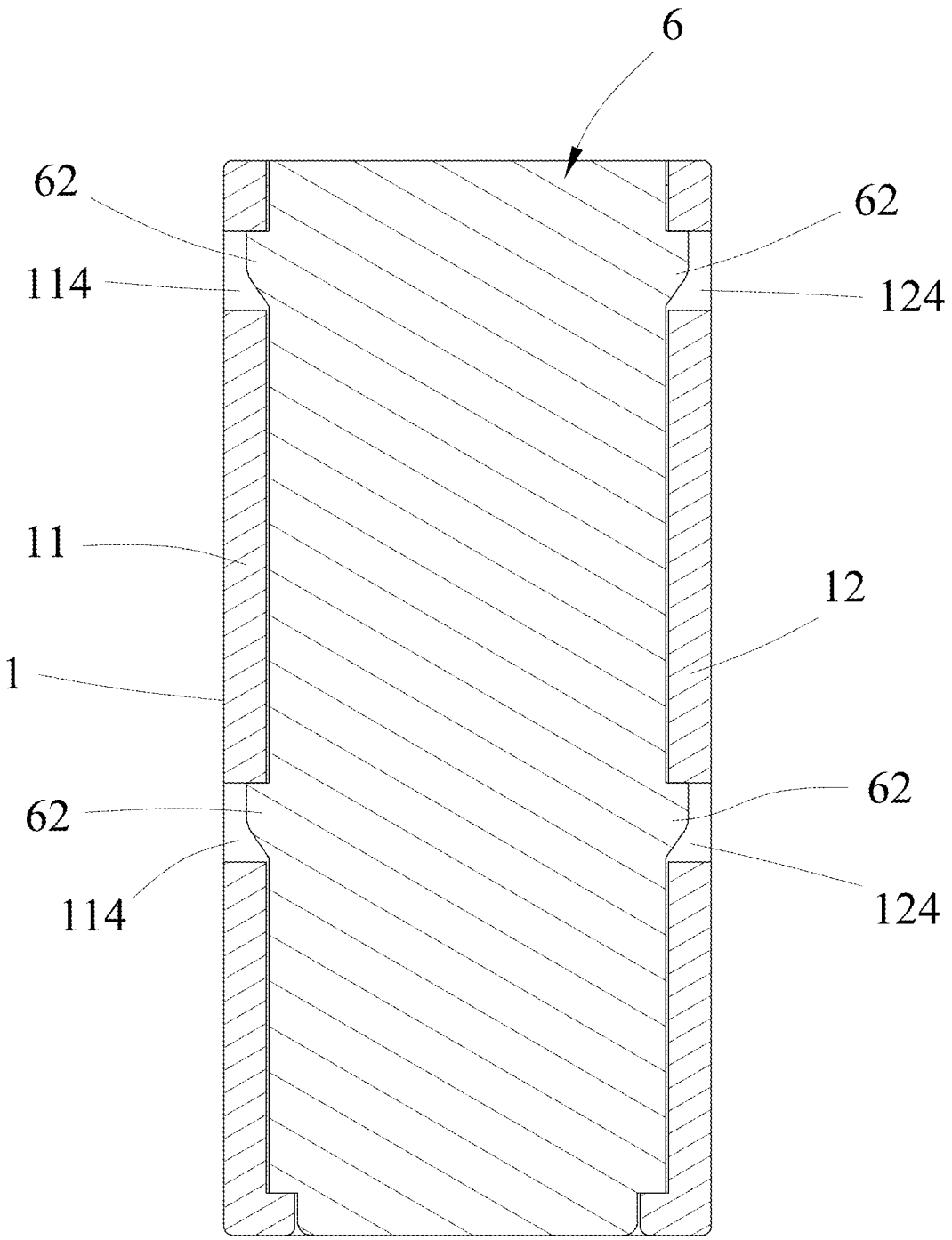
FIG. 3 is a front sectional view of a frame assembled with a cover plate of an embodiment according to the present invention.
Figure 4:
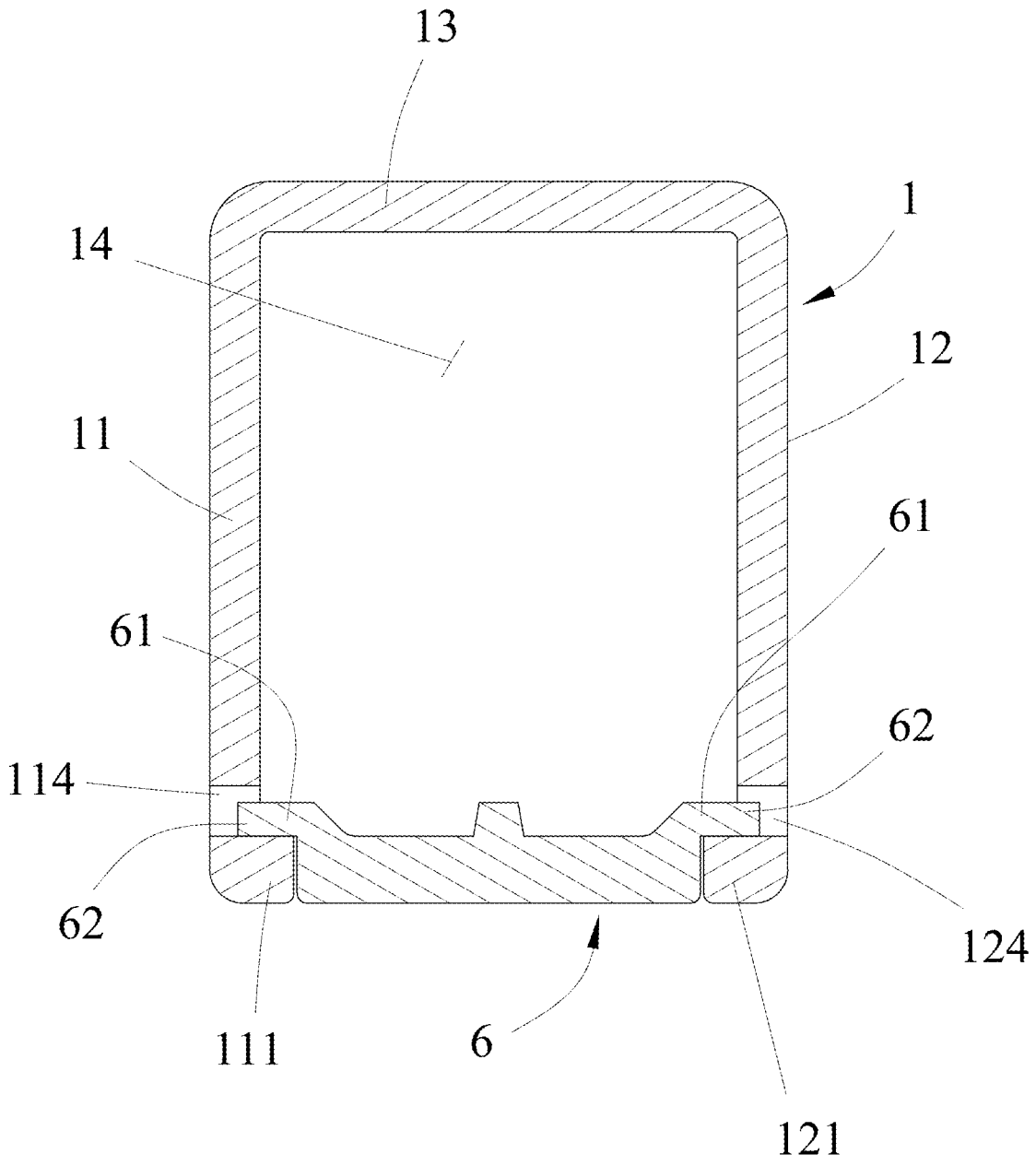
FIG. 4 is a top sectional view of a frame assembled with a cover plate of an embodiment according to the present invention.

In a preferred embodiment, the side of the first wall 11 away from the third wall 13 and the side of the second wall 12 away from the third wall 13 are respectively provided with at least two locking holes 114 and at least two locking holes 124 (as shown in FIG. 1 and FIG. 3). Each of the two sides of the cover plate 6 are further provided with at least two locking blocks 62 corresponding to the locking holes 114, 124. While the cover plate 6 being moved upward or downward to the furthest position, the cover plate 6 can be positioned firmly by the locking blocks 62 mounted into the locking holes 114, 124.

In a preferred embodiment, as shown in FIG. 1 and FIG. 2, a limit block 27 is arranged at an outer surface of the second vertical wall 22 of the moving part 2 away from the first vertical wall 21 and an opening 17 is disposed on the third wall 13 of the frame 1. When the moving part 2 is not lifted yet, the limit block 27 of the moving part 2 is mounted in the opening 17 correspondingly. After the moving part 2 being lifted and the insertion hole 26 of the moving part 2 aligned with the through hole 16 of the frame 1, the limit block 27 is just abutting against an upper edge of the third wall 13 of the frame 1 (as shown in FIG. 10). Thereby the moving part 2 at a lifted position is properly positioned and the fastener 5 can be conveniently inserted through the insertion hole 26 of the moving part 2 and the through hole 16 of the frame 1 and further threaded into the wall (as shown in FIG. 7-10).

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A bead chain or cord retainer comprising a frame, a moving part, and an elastic member;

wherein the frame includes a first wall, a second wall disposed opposite to the first wall, a third wall connected between one side of the first wall and one side of the second wall, a space penetrating vertically and defined by the first wall, the second wall, and the third wall, a limit rod disposed between the first wall and the second wall and across the space, and a through hole in the third wall;

wherein the moving part is composed of a first vertical wall, a second vertical wall, a connection segment connected between a top of the first vertical wall and a top of the second vertical wall, a passage penetrating horizontally and defined by the first vertical wall, the second vertical wall, and the connection segment, an extension segment extending from a bottom of the first vertical wall toward the second vertical wall, and an insertion hole in the second vertical wall close to a bottom of the second vertical wall; the passage allows a bead chain or a cord to insert through; by the connection segment of the moving part aligned with the limit rod of the frame, the first vertical wall and the second vertical wall are mounted into the space of the frame and a part of the passage is located between the first wall and the second wall;

wherein the elastic member is installed between the limit rod and the extension segment for allowing the moving part to be elastically mounted in the space and a changing area of the passage is located between the first wall and the second wall to clip or release the bead chain or the cord.

2. The retainer as claimed in claim 1, wherein an upper surface of the limit rod is a toothed surface.

3. The retainer as claimed in claim 2, wherein a lower surface of the limit rod is provided with a bulging block projecting toward the extension segment; a bump is arranged at an upper surface of the extension segment and projecting toward the limit rod; two ends of the elastic member are fitted to the bulging block and the bump correspondingly for positioning.

4. The retainer as claimed in claim 3, wherein a cover plate is vertically movable and disposed between another side of the first wall away from the third wall and another side of the second wall away from the third wall so that the cover plate is located opposite to the third wall; the side of the first wall away from the third wall and the side of the second wall away from the third wall are both provided with a joining edge; two joining steps are disposed on two sides of the cover plate and joined with the two joining edges correspondingly.

5. The retainer as claimed in claim 4, wherein the side of the first wall away from the third wall and the side of the second wall away from the third wall are both provided with at least two locking holes; each of the two sides of the cover plate is provided with at least two locking blocks corresponding to the locking holes; the locking blocks are able to be mounted into the locking holes correspondingly.

6. The retainer as claimed in claim 5, wherein a limit block is arranged at an outer surface of the second vertical wall away from the first vertical wall and an opening is disposed on the third wall of the frame; the limit block is mounted in the opening correspondingly when the moving part is not lifted; after the moving part is lifted and the insertion hole aligned with the through hole, the limit block is abutting against an upper edge of the third wall.

7. The retainer as claimed in claim 1, wherein a lower surface of the limit rod is provided with a bulging block projecting toward the extension segment; a bump is arranged at an upper surface of the extension segment and projecting toward the limit rod; two ends of the elastic member are fitted to the bulging block and the bump correspondingly for positioning.

8. The retainer as claimed in claim 7, wherein a cover plate is vertically movable and disposed between another side of the first wall away from the third wall and another side of the second wall away from the third wall so that the cover plate is located opposite to the third wall; the side of the first wall away from the third wall and the side of the second wall away from the third wall are both provided with a joining edge; two joining steps are disposed on two sides of the cover plate and joined with the two joining edges correspondingly.

9. The retainer as claimed in claim 8, wherein the side of the first wall away from the third wall and the side of the second wall away from the third wall are both provided with at least two locking holes; each of the two sides of the cover plate is provided with at least two locking blocks corresponding to the locking holes; the locking blocks are able to be mounted into the locking holes correspondingly.

10. The retainer as claimed in claim 9, wherein a limit block is arranged at an outer surface of the second vertical wall away from the first vertical wall and an opening is disposed on the third wall of the frame; the limit block is mounted in the opening correspondingly when the moving part is not lifted; after the moving part being lifted and the insertion hole aligned with the through hole, the limit block is abutting against an upper edge of the third wall.

11. The retainer as claimed in claim 2, wherein a positioning member is inserted into the insertion hole of the moving part; the positioning member includes an insertion pin and a limiting piece integrally connected with one end of the insertion pin and provided with at least two limiting edges on a periphery of the limiting piece; after the frame, the moving part, the elastic member, and the bead chain or the cord are assembled and the insertion pin of the positioning member is inserted into the insertion hole of the moving part, one of the limiting edges of the limiting piece is in contact with and abutting against a lower edge of the third wall of the frame.

12. The retainer as claimed in claim 11, wherein the two limiting edges on the periphery of the limiting piece have different abutting levels each of which is defined as a distance between an axis of the insertion pin and the limiting edge.

13. The retainer as claimed in claim 12, wherein a truncated conical tenon is disposed on one end of the insertion pin away from the limiting piece; at least one notch is axially mounted to the insertion pin from the end of the insertion pin connected with the truncated conical tenon.

14. The retainer as claimed in claim 13, wherein a top side, a bottom side, a left side, and a right side of a surface of the insertion hole are all provided with a positioning groove; an outer surface of the insertion pin of the positioning member is provided with at least one locking strip disposed axially; a relative position of the positioning member with respect to the insertion hole is fixed by the locking strip mounted into one of the positioning grooves correspondingly.

15. The retainer as claimed in claim 1, wherein a positioning member is inserted into the insertion hole of the moving part; the positioning member includes an insertion pin and a limiting piece integrally connected with one end of the insertion pin and provided with at least two limiting edges on a periphery of the limiting piece; after the frame, the moving part, the elastic member, and the bead chain or the cord being assembled and the insertion pin of the positioning member being inserted into the insertion hole of the moving part, the limiting edge of the limiting piece is in contact with and abutting against a lower edge of the third wall of the frame.

16. The retainer as claimed in claim 15, wherein the two limiting edges on the periphery of the limiting piece have different abutting levels each of which is defined as a distance between an axis of the insertion pin and the limiting edge.

17. The retainer as claimed in claim 16, wherein a truncated conical tenon is disposed on one end of the insertion pin away from the limiting piece; at least one notch is axially mounted to the insertion pin from the end of the insertion pin connected with the truncated conical tenon.

18. The retainer as claimed in claim 17, wherein a top side, a bottom side, a left side, and a right side of a surface of the insertion hole are all provided with a positioning groove; an outer surface of the insertion pin of the positioning member is provided with at least one locking strip disposed axially; a relative position of the positioning member with respect to the insertion hole is fixed by the locking strip mounted into one of the positioning grooves correspondingly.

* * * * *